US007383681B2

(12) United States Patent
Connolly et al.

(10) Patent No.: US 7,383,681 B2
(45) Date of Patent: Jun. 10, 2008

(54) METHOD AND APPARATUS FOR COORDINATED LINKAGE MOTION

(75) Inventors: John R. Connolly, Clayton, NC (US); Anil Shenoy, Raleigh, NC (US)

(73) Assignee: Caterpillar Inc., Peoria, IL (US)

( * ) Notice: Subject to any disclaimer, the term of this patent is extended or adjusted under 35 U.S.C. 154(b) by 182 days.

(21) Appl. No.: 11/484,155

(22) Filed: Jul. 11, 2006

(65) Prior Publication Data

US 2008/0011155 A1 Jan. 17, 2008

(51) Int. Cl.
*F15B 11/16* (2006.01)
*E02F 9/22* (2006.01)

(52) U.S. Cl. ..... 60/426; 91/508

(58) Field of Classification Search ..... 60/426; 91/508, 514, 517, 518
See application file for complete search history.

(56) References Cited

U.S. PATENT DOCUMENTS 4,157,736 A * 6/1979 Carbert ..... 91/518
5,259,192 A * 11/1993 Karakama et al. ..... 91/518
6,148,254 A 11/2000 Barden
6,354,790 B1 * 3/2002 Cummings et al. ..... 37/403
6,385,870 B1 5/2002 Webel et al.
6,450,081 B1 9/2002 Sorbel
6,659,531 B2 * 12/2003 Searfoss ..... 91/517
2004/0261301 A1 12/2004 Vering et al.
2005/0081518 A1 4/2005 Ma et al.
2005/0102865 A1 5/2005 Bell et al.
2005/0138850 A1 6/2005 Brickner et al.
2005/0193599 A1 9/2005 McCoy
2005/0220601 A1 10/2005 Pisco

OTHER PUBLICATIONS

Rockland Thumb Brochure, [online], (retrieved on May 9, 2006) Retrieved from the Rockland website using internet <URL: http://www.rocklandmfg.com/excavator/thumbs.htm>.
Rockland Get It Fast Sheet, [online], (retrieved on May 9, 2006) Retrieved from the Rockland website using internet <URL: http://www.rocklandmfg.com/get_it_fast_sheet.htm>.

* cited by examiner

*Primary Examiner*—Thomas E Lazo
(74) *Attorney, Agent, or Firm*—William A. Beckman

(57) ABSTRACT

A hydraulic system is provided. The hydraulic system includes a source of pressurized fluid, a first control valve, a first actuator, a second control valve, a second actuator, and a relief. The first control valve is coupled to the source of pressurized fluid. The first actuator is coupled to the first control valve and has a first end and a second end. The second control valve is coupled to the source of pressurized fluid. The second actuator is coupled to the second control valve and has a first end and a second end. The relief has an input and an output, with the input coupled to the first end of the second actuator and the output coupled to the second end of the second actuator and the second end of the first actuator.

17 Claims, 2 Drawing Sheets

METHOD AND APPARATUS FOR COORDINATED LINKAGE MOTION

TECHNICAL FIELD

This invention relates generally to a method and apparatus for coordinated linkage motion, and more particularly, to a hydraulic system of a machine having a coordinated linkage motion.

BACKGROUND

Mining and construction machines such as backhoe loaders and excavators employ various implements, such as buckets, rams, forks, grapples, thumbs, etc., to perform different operations. For example, a machine may use counteracting thumbs and buckets to grasp, hold, and lift odd-shaped articles such as pipes, structural components, and the like. Hydraulic actuators typically control these thumbs and buckets. Due to different kinematics and varying cylinder geometry, moving the bucket and thumb together in a coordinated manner is not easy. For example, if the hydraulic actuators for the thumb and the bucket are both extended the same amount, the thumb may move a different angular distance than the bucket. Moreover, the hydraulic actuators for the thumb and the bucket may extend or retract at different rates given the same flow of hydraulic fluid.

Methods have been proposed to attempt to coordinate the linkage motion between the thumb and the bucket. For example, U.S. Pat. No. 6,385,870 to Webel ("Webel") discloses a control system for an excavator thumb and a method of controlling an excavator thumb. Webel uses a thumb control circuit that is activated by the press of a button and maintains a constant reduced close fluid pressure of the extend port of the thumb cylinder until the open control is actuated.

While Webel provides a technique that seeks to maintain a constant thumb cylinder pressure as the bucket rotates, Webel requires activation of a separate switch. In addition, the hydraulic circuit of Webel requires complex circuitry and plumbing that may not be suitable for retrofit applications.

The present invention is directed to overcome one or more of the problems as set forth above.

SUMMARY OF THE INVENTION

In one aspect of the present invention, a hydraulic system is provided. The hydraulic system includes a source of pressurized fluid, a first control valve, a first actuator, a second control valve, a second actuator, and a relief. The first control valve is coupled to the source of pressurized fluid. The first actuator is coupled to the first control valve and has a first end and a second end. The second control valve is coupled to the source of pressurized fluid. The second actuator is coupled to the second control valve and has a first end and a second end. The relief has an input and an output, with the input coupled to the first end of the second actuator and the output coupled to the second end of the second actuator and the second end of the first actuator.

In another aspect of the present invention, a machine is provided. The machine includes a linkage, a source of pressurized fluid, a first control valve, a first actuator, a second control valve, a second actuator, and a relief. The linkage has a first member operably coupled to a second member. The first control valve is coupled to the source of pressurized fluid. The first actuator is operably coupled to the first member, coupled to the first control valve, and has a first end and a second end. The second control valve is coupled to the source of pressurized fluid. The second actuator is operably coupled to the second member, coupled to the second control valve, and has a first end and a second end. The relief has an input and an output, the input coupled to the first end of the second actuator and the output coupled to the second end of the second actuator and the second end of the first actuator.

A third aspect of the present invention includes a method for coordinating linkage motion. The linkage has a first member coupled to a second member, a first actuator coupled to the first member and a second actuator coupled to the second member, with the first and second actuators each having a first end and a second end, and a relief having an input and an output, the input coupled to the first end of the second actuator and the output coupled to the second end of the second actuator and second end of the first actuator. The method includes the step of providing pressurized fluid to the first end of the first actuator. The method also includes the step of routing hydraulic fluid from the first end of the second actuator through the relief to the second end of the second actuator. The method also includes the step of routing hydraulic fluid from the first end of the second actuator through the relief to the second end of the first actuator. The method also includes the step of routing hydraulic fluid from the second end of the first actuator to a fluid reservoir.

DETAILED DESCRIPTION

Figure 1:
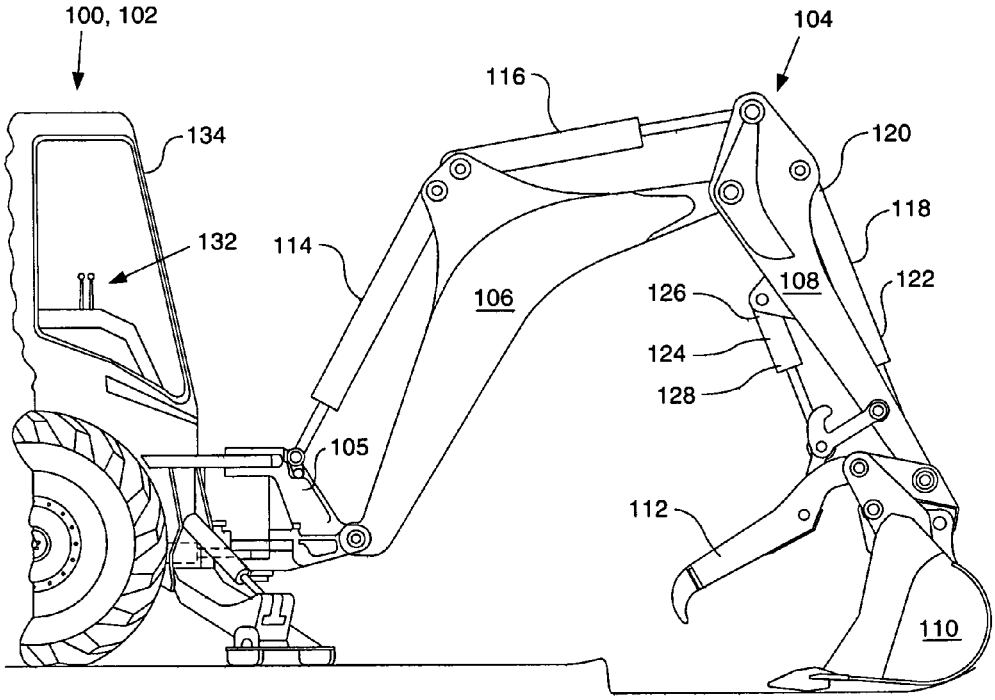
FIG. 1 is a drawing of a machine suitable for use with the present invention.

FIG. 1 depicts a machine 100 having a linkage assembly 104 in accordance with the present invention. The machine 100 is depicted as a backhoe loader 102, but may also be an excavator or any other machine having a linkage. As shown, the linkage assembly 104 includes a boom 106, a stick 108 pivotally coupled to the boom 106, a bucket 110 pivotally coupled to the stick 108, and a thumb 112 also pivotally coupled to the stick 108. The linkage assembly 104 is shown pivotally connected to a boom support bracket 105. An actuator 114 is operably coupled to the boom 106 and the machine 100 and rotates the boom 106 with respect to the machine 100. Similarly, an actuator 116 is operably coupled to the boom 106 and the stick 108 and rotates the stick 108 with respect to the boom 106. Actuators 118, 124 are operably coupled to the stick 108 and the bucket 110 and thumb 112, respectively, and rotate the bucket 110 and thumb 112 with respect to the stick 108. The actuators 114, 116, 118, 124 may be hydraulic cylinders each having a head end and a rod end. Directing hydraulic fluid to the head end extends the actuator 114, 116, 118, 124, while directing fluid to the rod end retracts the actuator 114, 116, 118, 124. An operator may use a plurality of levers 132 within an operator cab 134 of the machine 100 to command the actuators 114, 116, 118, 124 through a control device (not shown).

Figure 2:
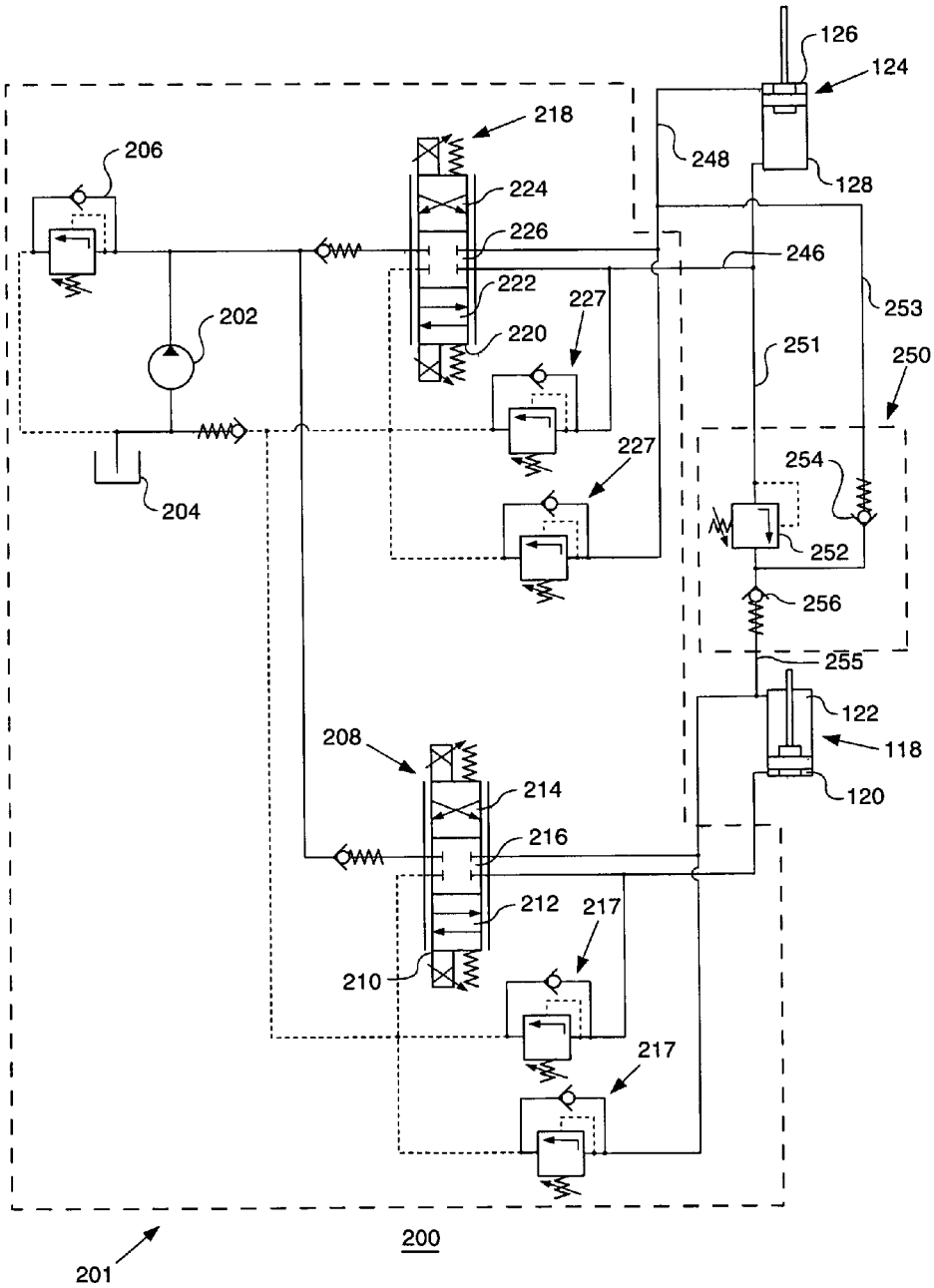
FIG. 2 is a schematic of an embodiment for use with the present invention.

FIG. 2 is a schematic of a hydraulic system 200 of the machine 100. The hydraulic system 200 includes a main system 201 hydraulically coupled to the bucket actuator 118 and the thumb actuator 124, with an auxiliary valve block 250 hydraulically coupling the thumb actuator 124 to the bucket actuator 118. The main system 201 includes a source of pressurized fluid 202, which may be a pressure compensated variable displacement pump, although other pumps may also be used. Coupled to the source of pressurized fluid 202 is a reservoir of fluid 204. The main system 201 may also include a pressure relief valve 206 for relieving excess pressure in a known manner.

The main system 201 also includes a first directional control valve 208 that hydraulically couples both the source of pressurized fluid 202 and the reservoir of fluid 204 to a head end 120 and a rod end 122 of the bucket actuator 118. The levers 132 drive a spool 210 within the directional control valve 208 to one of three positions: a first position 212 routing fluid from the source of pressurized fluid 202 to the head end 120, while allowing excess fluid from the bucket actuator 118 to flow from the rod end 122 to the reservoir of fluid 204; a second position 214 routing fluid from the source of pressurized fluid 202 to the rod end 122, while allowing excess fluid from the bucket actuator 118 to flow from the head end 120; and a third position 216 shutting off all flow through the directional control valve 208. Relief valves 217 may be placed between the directional control valve 208 and the bucket actuator 118.

Similarly, the main system 201 also includes a second directional control valve 218 that hydraulically couples both the source of pressurized fluid 202 and the reservoir of fluid 204 to a head end 126 and a rod end 128 of the thumb actuator 124. A first hydraulic line 246 hydraulically couples the directional control valve 218 to the head end 126, while a second hydraulic line 248 hydraulically couples the directional control valve 218 to the rod end 128. The levers 132 drive a spool 220 within the directional control valve 218 to one of three positions: a first position 222 routing fluid from the source of pressurized fluid 202 to the head end 126, while allowing excess fluid from the thumb actuator 124 to flow from the rod end 128 to the reservoir of fluid 204; a second position 224 routing fluid from the source of pressurized fluid 202 to the rod end 128, while allowing excess fluid from the thumb actuator 124 to flow from the head end 126; and a third position 226 shutting off all flow through the directional control valve 218. Relief valves 227 may be placed between the directional control valve 218 and the thumb actuator 124. The spools 210, 220 may be a closed-center, spring, centered, operated control valve, but alternately could be a solenoid type, pressure compensated valve, or any like valve.

The auxiliary valve block 250 may be mounted on the linkage assembly 104, external to the machine 100, although other the auxiliary valve block 250 may also be mounted in other locations, such as integral with the main system 200 or internal to the machine 100. The valve block 250 includes an input 251 and outputs 253, 255. The input 251 is hydraulically coupled to the head end 126 of the thumb actuator 124, while the outputs 253, 255 are hydraulically coupled to the rod end 128 of the thumb actuator 124 and the rod end 122 of the bucket actuator 118. The valve block 250 also includes a relief valve 252 and a first and a second check valve 254, 256 downstream of the relief valve 252.

INDUSTRIAL APPLICABILITY

In operation, an operator may use levers 132 to move the boom 106, stick 108, bucket 110, and thumb 112. For example, by moving the levers 132 to shift the spools 210, 220 within the first and second directional control valves 208, 218 to the first position 212, 222, both the bucket actuator 118 and the thumb actuator 124 extend, rotating the bucket 110 and the thumb 112 towards one another. By moving the levers 132 to shift the spools 210, 220 to the second position 214, 224, the bucket actuator 118 and the thumb actuator 124 retract, rotating the bucket 110 and the thumb 112 away from one another.

After an operator has rotated the bucket 110 and the thumb 112 towards one another, closing the bucket 110 and the thumb 112, the auxiliary valve block 250 allows for a coordinated linkage motion. Rather than blow a relief valve 217, 227 in the first or second hydraulic lines 246, 248, the relief valve 252 in the auxiliary valve block 250 is blown, allowing the bucket actuator 118 to overpower the thumb actuator 124. The excess hydraulic oil from the head end 126 of the thumb actuator 124 is sent through the first check valve 254 to the rod end 128 of the thumb actuator 124 as make-up fluid. Because the oil discharging from the relief 252 may be greater than the volume that can be taken up by the rod end 128 of the thumb actuator 124 due to cylinder ratios, the excess oil from the head end 126 of the thumb actuator 124 is also sent through the second check valve 256 to the rod end 122 of the bucket actuator 118 to the reservoir of fluid 204.

Several advantages over the prior art may be associated with the hydraulic system 200 of the machine 100. For example, the configuration of the auxiliary valve block 250 allows for a compact, space efficient design, requiring only a single pair of hydraulic lines 246, 248 to extend to the thumb actuator 124. In addition, the design also allows for a modular setup. An operator does not need to adjust the relief setting when another hydraulic implement is used. By disconnecting the hydraulic lines 246, 248 from the thumb actuator 124 and connecting the lines 246, 248 to a different hydraulic implement, the relief valves 217, 227 within the main system 201 are used, and not the relief valve 252 of the auxiliary valve block 250, which may be set to a much lower setting than that in the main system 201.

Other aspects, objects and advantages of this invention can be obtained from a study of the drawings, the disclosure, and the appended claims.

What is claimed is:

1. A hydraulic system comprising:

a source of pressurized fluid;

a first control valve coupled to the source of pressurized fluid;

a first actuator coupled to the first control valve and having a first end and a second end;

a second control valve coupled to the source of pressurized fluid;

a second actuator coupled to the second control valve and having a first end and a second end; and a relief having an input and an output, the input coupled to the first end of the second actuator and the output coupled to the second end of the second actuator and the second end of the first actuator.

2. The hydraulic system of claim 1, wherein the first and second control valves are hydraulic cylinders.

3. The hydraulic system of claim 2, wherein the first end of the first and second actuators is a head end, and the second end of the first and second actuators is a rod end.

4. The hydraulic system of claim 1 further comprising:

a first check valve positioned between the output and the second end of the second actuator; and a second check valve positioned between the output and the second end of the first actuator.

5. The hydraulic system of claim 1, further comprising:

a fluid reservoir coupled to the first and second-control valves;

wherein the second end of the second actuator is coupled to the reservoir through the relief and the first control valve.

6. A machine comprising:

a linkage having a first member operably coupled to a second member;

a source of pressurized fluid;

a first control valve coupled to the source of pressurized fluid;

a first actuator operably coupled to the first member, the first actuator coupled to the first control valve and having a first end and a second end;

a second control valve coupled to the source of pressurized fluid;

a second actuator operably coupled to the second member, the second actuator coupled to the second control valve and having a first end and a second end; and a relief having an input and an output, the input coupled to the first end of the second actuator and the output coupled to the second end of the second actuator and the second end of the first actuator.

7. The machine of claim 6, wherein the first and second control valves are hydraulic cylinders.

8. The machine of claim 7, wherein the first end of the first and second actuators is a head end, and the second end of the first and second actuators is a rod end.

9. The machine of claim 6, further comprising:

a first check valve positioned between the output and the second end of the second actuator; and a second check valve positioned between the output and the second end of the first actuator.

10. The machine of claim 6, further comprising:

a fluid reservoir coupled to the first and second control valves;

wherein the second end of the second actuator is coupled to the reservoir through the relief and the first control valve.

11. The machine of claim 10, wherein the first member is a bucket and the second member is a thumb.

12. The machine of claim 10, wherein the machine is a backhoe loader or excavator.

13. A method for coordinating linkage motion, the linkage having a first member coupled to a second member, a first actuator coupled to the first member and a second actuator coupled to the second member, the first and second actuators each having a first end and a second end, and a relief having an input and an output, the input coupled to the first end of the second actuator and the output coupled to the second end of the second actuator and second end of the first actuator, comprising the steps of:

providing pressurized fluid to the first end of the first actuator;

routing hydraulic fluid from the first end of the second actuator through the relief to the second end of the second actuator;

routing hydraulic fluid from the first end of the second actuator through the relief to the second end of the first actuator; and routing hydraulic fluid from the second end of the first actuator to a fluid reservoir.

14. The method of claim 13, further including the steps of:

positioning a first check valve between the output and the second end of the second actuator; and positioning a second check valve between the output and the second end of the first actuator.

15. The method of claim 13, wherein the first end of the first and second actuators is a head end, and the second end of the first and second actuators is a rod end.

16. The method of claim 13, wherein the first member is a bucket and the second member is a thumb.

17. The method of claim 13, wherein the linkage is coupled to a backhoe loader or an excavator.

* * * * *